US010045608B2

(12) United States Patent
Medico

(10) Patent No.: US 10,045,608 B2
(45) Date of Patent: Aug. 14, 2018

(54) SEVEN SHAPE TOOTHBRUSH

(71) Applicant: Giovanni Medico, Brindisi (IT)

(72) Inventor: Giovanni Medico, Brindisi (IT)

(73) Assignees: Giovanni Medico, Brindisi (IT); Alexander F. Medico More, Hull, MA (US)

( * ) Notice: Subject to any disclaimer, the term of this patent is extended or adjusted under 35 U.S.C. 154(b) by 100 days.

(21) Appl. No.: 15/231,144

(22) Filed: Aug. 8, 2016

(65) Prior Publication Data

US 2018/0035796 A1 Feb. 8, 2018

(51) Int. Cl.

| | |
|---|---|
| ***A46B 9/04*** | (2006.01) |
| ***A46B 7/04*** | (2006.01) |
| ***A46B 5/00*** | (2006.01) |

(52) U.S. Cl.

CPC ..... *A46B 9/04* (2013.01); *A46B 5/0083* (2013.01); *A46B 7/042* (2013.01); *A46B 7/044* (2013.01); *A46B 2200/1066* (2013.01)

(58) Field of Classification Search

CPC ..... A46B 9/04; A46B 5/0083; A46B 7/042; A46B 7/044

See application file for complete search history.

(56) References Cited

U.S. PATENT DOCUMENTS

| | | | | | |
|---|---|---|---|---|---|
| 2,111,880 | A * | 3/1938 | Waters | A46B 7/02 | 15/172 |
| 2,429,437 | A * | 10/1947 | Walker | A46B 7/02 | 15/172 |
| 2,864,111 | A * | 12/1958 | Rotceig | A46B 7/02 | 15/167.1 |
| 5,412,831 | A * | 5/1995 | Mongelluzzo | A46B 7/04 | 15/144.1 |
| 2011/0247153 | A1* | 10/2011 | Byeon | A61C 17/32 | 15/22.1 |
| 2014/0217807 | A1* | 8/2014 | Kayser | A46D 3/00 | 300/21 |

* cited by examiner

*Primary Examiner* — Shay Karls

(57) ABSTRACT

This toothbrush presents an independent base of support for the bristles. The bristles' base is positioned on the structure of the head of the toothbrush itself, in such a way that half of the base remains fixed to the head of the toothbrush structure, while the second half can be raised, giving to the whole base a curved-angle profile. A half of this base has this ability to be free to rise at an angle, driven by a sliding rod, which is pushed with a finger of the hand holding the toothbrush. The rod slides through an inclined opening placed underneath the head of the toothbrush. In order to return the base to its horizontal position, the rod itself is retracted, in the same way, using a finger of the hand holding the toothbrush. The lowering of the base itself is facilitated by the pressure of the toothbrush on the teeth.

1 Claim, 2 Drawing Sheets

SEVEN SHAPE TOOTHBRUSH

BACKGROUND OF THE INVENTION

1. Field of Invention

The present invention concerns the field of dental care. Specifically, the invention presents a new toothbrush design intended to improve oral care by adapting the shape of the bristles to the curve of the dental arch.

2. Description of the Prior Art

For most persons the dental arch of the upper teeth ends in an upward curve, making it difficult for bristles of equal length to reach the back of the arch and molar teeth, especially after the extraction of third molars, also known as wisdom teeth. Existing toothbrush designs have attempted to adapt to the curve of the dental arch by offering a plurality of bristles of different length, becoming longer toward the distal end of the toothbrush head. Such solutions are inefficient, since the permanent asymmetrical shape of the toothbrush causes one end of the bristles to become worn faster. Even in its pristine state, such toothbrushes do not reach the back of the dental arch properly, especially if the user has undergone the extraction of molar teeth, requiring extra care in reaching in between remaining teeth.

The present invention addresses these shortcomings, by providing a mechanism that allows the user to adapt the shape of the toothbrush to the curvature of the dental arch of any individual. By pushing on a rod that slides within the toothbrush head and reaches the distal half of the base where bristles are affixed, the user can modify the curvature of the bristles to fit the specific shape and curvature of his or her dental arch. The convex shape of the bristles obtained thus is far more dynamic than the static designs in prior art, offering each individual the ability to mold the toothbrush's bristles to the angle that achieves more efficient, thorough and hygienic brushing.

DESCRIPTION OF THE INVENTION

Figure 1:
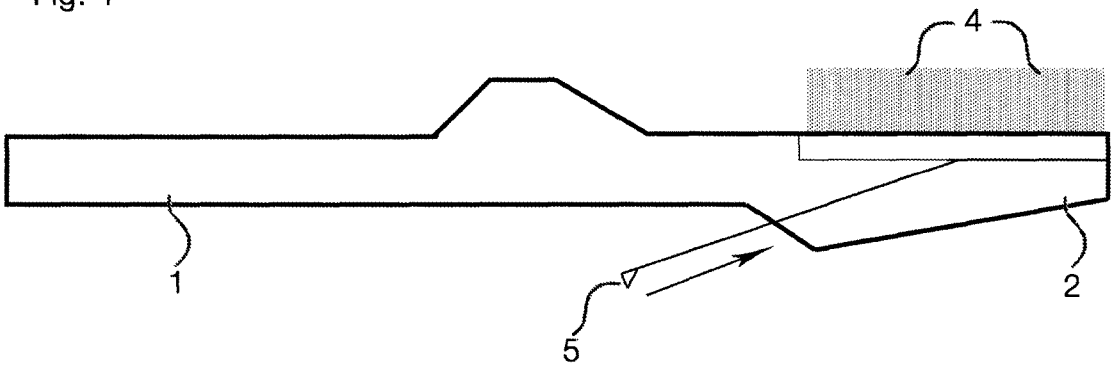
FIG. 1 is a profile view of the toothbrush embodiments, with a sectional view of the toothbrush head and sliding rod retracted in the duct, with the distal section of the bristles in a flat, resting position.
Figure 2:
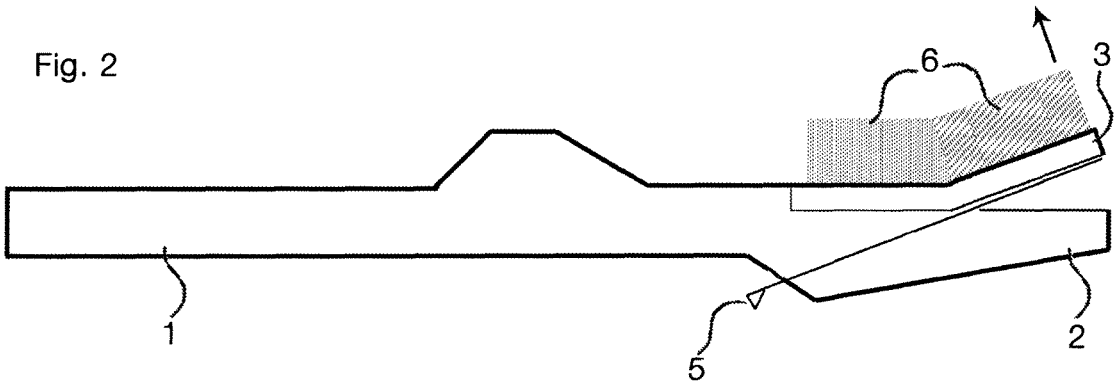
FIG. 2 is a profile view of the toothbrush embodiments, with a sectional view of the toothbrush head and sliding rod inserted, and thus with the distal section of the bristles in a convex position.
Figure 3:
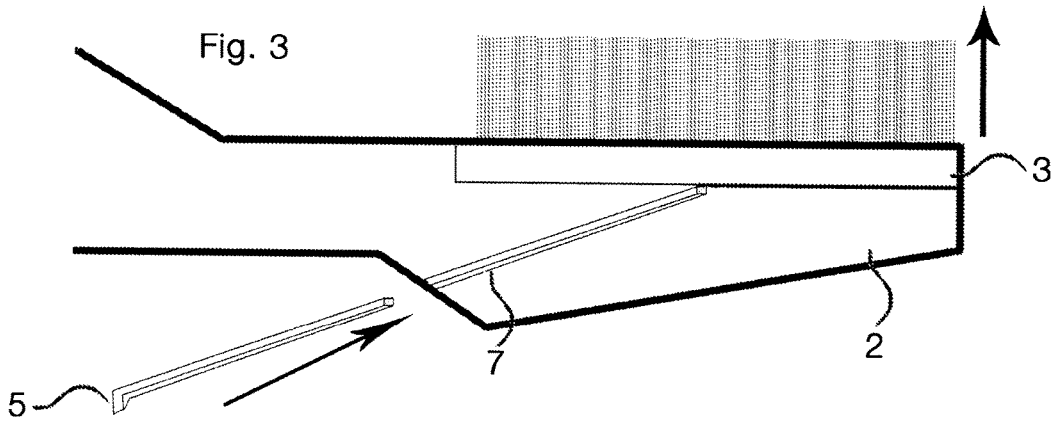
FIG. 3 is an enlarged profile view of the toothbrush embodiments, with a sectional view of the toothbrush head and sliding rod retracted in the duct, with the distal section of the bristles in a flat, resting position.
Figure 4:
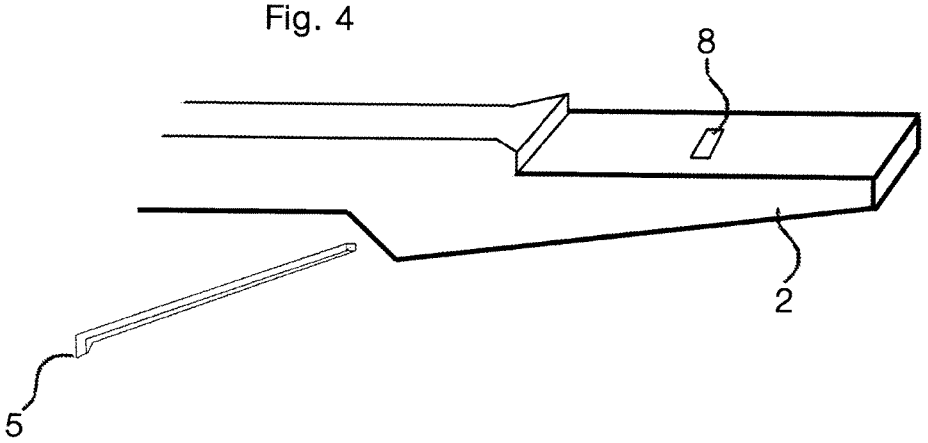
FIG. 4 is a profile view of the toothbrush embodiments without the bristles and the base on which they are attached to, showing the structure of the toothbrush head and the upper opening of the duct.

This toothbrush presents an independent base of support for the bristles 4, base that is applied to the structure of the toothbrush itself. It has been conceived to make possible this operation: while a half of the base remains fixed to the toothbrush structure, the second half 3 can be raised, giving to the whole base a convex curved angle profile 6. A half 3 of this base 4 has the property to be free to rise at an angle 6, driven by a sliding rod 5, which is pushed with a finger of the hand holding the toothbrush. The rod 5 slides through an inclined opening 7 along a specially enlarged section of the handle 2. In order to return to the horizontal position of the base 4, the rod itself 5 is retracted, in the same way, using a finger of the hand holding the toothbrush, while the lowering of the base itself is facilitated by the pressure of the toothbrush on the teeth.

The base 4 on which the bristles are fixed has to be constructed as an independent body that is applied to the structure of the toothbrush 2. This base 4 must be made of a material such as to be able to support the bristles and at the same time be curved to allow folding, according to the operation described above. The materials of which this toothbrush is composed are not different from those generally used and adopted for the other toothbrushes on the market.

The curve 6 of the base supporting the bristles is conceived to allow the cleaning of those areas in the rear of the dental arch, otherwise accessible from the bristles located at the end section in a traditional toothbrush; in this way, compared to a traditional toothbrush, the effectiveness of cleaning is certainly greater. Also, for the side of the teeth, anterior, lateral and front, this brush proves to be more effective, being able to adapt to the curve of the dental arch.

With half of the base 3 in a curved position 6, the brush can reach those teeth located in the extreme rear of the dental arch, which is very useful in particular when the teeth located here prove to be isolated due to extraction of other adjacent teeth, a common occurrence, for example, with the last molar teeth, so-called wisdom teeth. Since this portion 3 of the base does not have a limited number of bristles—as occurs in traditional toothbrushes that have a small group of longer bristles situated at the end of the based itself—but a greater number of them, the cleaning of the posterior teeth much more effective.

The number and quality of the bristles, and their position on the support base, is consistent and constant, without empty areas, so as to constitute a valid and effective area of contact with the teeth.

I claim:

1. A toothbrush comprising:

a handle and a toothbrush head both located along a longitudinal axis, wherein the toothbrush head comprises a flexible bristle base;

a plurality of bristles are fixed on the bristle base;

the bristle base is divided into a proximal half and a distal half;

the proximal half of the bristle base is located closest to the handle and the distal half of the bristle base is located at an opposite end of the toothbrush head;

the proximal half of the bristle base is fastened to the toothbrush head and the distal half of the bristle base is not attached to the toothbrush head;

a rear surface of the toothbrush head comprises an internal duct that extends at an angle to the longitudinal axis;

the duct extends from a rear opening on the rear surface of the toothbrush head to an upper opening on a top surface of the toothbrush head located underneath the distal half of the bristle base;

a rod having a width that is substantially equal to the width of the duct is received within the rear opening and is capable of sliding through the duct;

the rod has a length such a user can slide the rod with a finger, while holding the handle, from the rear opening of the duct to the upper opening; wherein when the rod is pushed by the user through the duct and outwardly from the upper opening, it contacts and lifts the distal half of the bristle base to form a convex shape;

when the rod is retracted, the distal half of the bristle base is returned to a flat shape.

* * * * *